US012349825B2

(12) United States Patent
Bledsoe

(10) Patent No.: US 12,349,825 B2
(45) Date of Patent: Jul. 8, 2025

(54) ADJUSTABLE BED SHEET

(71) Applicant: Caleb Bledsoe, Sugar Land, TX (US)

(72) Inventor: Caleb Bledsoe, Sugar Land, TX (US)

( * ) Notice: Subject to any disclaimer, the term of this patent is extended or adjusted under 35 U.S.C. 154(b) by 270 days.

(21) Appl. No.: 17/858,792

(22) Filed: Jul. 6, 2022

(65) Prior Publication Data

US 2023/0011381 A1 Jan. 12, 2023

Related U.S. Application Data

(60) Provisional application No. 63/218,788, filed on Jul. 6, 2021.

(51) Int. Cl.
*A47G 9/02* (2006.01)

(52) U.S. Cl.
CPC ..... *A47G 9/0246* (2013.01)

(58) Field of Classification Search
CPC ..... A47G 9/0246; A47G 9/04; A47G 9/0238; A47G 9/02; A47G 9/0223; A47G 9/0253; A47G 9/0292; A47G 11/004; A47G 2009/001; A47G 2009/0276; A47G 21/167; A47G 2200/12; A47G 11/003; A47G 9/062; A61G 2203/74; A47C 21/022; A47C 21/028; A47C 31/10; A47C 21/06; A47C 21/00; A47C 21/02; A47C 31/00; A47C 31/105; A47C 7/00; A43C 7/00; A44B 13/0058
USPC ..... 5/484, 498, 499, 496, 497, 482, 495, 5/504.1, 690, 691, 737, 417; 24/712; 38/140
See application file for complete search history.

(56) References Cited

U.S. PATENT DOCUMENTS

| | | | | |
|---|---|---|---|---|
| 5,809,593 | A * | 9/1998 | Edwards | A47G 9/0246 5/482 |
| 9,549,625 | B1 * | 1/2017 | Wilkinson | A47G 9/0223 |
| 10,610,034 | B2 * | 4/2020 | Sturgeon | A47G 9/0292 |
| 2018/0014666 | A1 * | 1/2018 | Blazejewski | A47G 9/0246 |
| 2021/0120964 | A1 * | 4/2021 | Nekhala | A47C 21/022 |

OTHER PUBLICATIONS

Definition—Handle—Vocabulary.com, https://www.vocabulary.com/dictionary/handle (Year: 2019).*

* cited by examiner

*Primary Examiner* — Madison Emanski
(74) *Attorney, Agent, or Firm* — Cynthia S. Lamon; Lamon Patent Services

(57) ABSTRACT

A material cover includes a swath of material of sufficient width and length to cover a form, a cable sheath generally disposed about the peripheral edge of the swath of material on one side of the material swath, an elastic cable having a diameter just smaller than the inside diameter of the cable sheath threaded through the cable sheath, a cinch mechanism disposed in the path of the cable sheath, the cinch mechanism having an inside diameter the same or just smaller than twice the diameter of the elastic cable, and a pull line attached to or formed contiguously from the elastic cable, the pull line extending some length to an ergonomic handle operable by a user.

19 Claims, 3 Drawing Sheets

ADJUSTABLE BED SHEET

CROSS-REFERENCE TO RELATED DOCUMENTS

The present invention claims priority to a U.S. provisional patent application Ser. No. 63/218,788 entitled "Adjustable Bed Sheet", filed on Jul. 6, 2021 disclosure of which is included herein at least be reference.

BACKGROUND OF THE INVENTION

1. Field of the Invention

The present invention is in the field of textiles, more particularly bed coverings adapted as fitted bed coverings including bed sheets and pertains to a method and apparatus for obtaining a tight and wrinkle free cover for mattresses that may vary in size and in some instances shape.

2. Discussion of the State of the Art

In the field of textiles, more particularly fitted bedsheets, most are manufactured for a single dedicated use. There are many diverse types of standard and non-standard sizes for beds having mattresses the standards having names including King, California King, Queen, Double, and Twin. In addition, there are many non-standard or specialty sizes of mattresses beds of trailers, tiny houses, campers, and so on. Moreover, mattresses may assume various shapes, vary in thickness for various purposes. Bed coverings including sheets are typically limited in application to the mattress size and shape the covering is provided for.

The inventor is aware of a bed sheet U.S. Pat. No. 5,046,207 modified with an elastic band sewn into the sheet that may be adjusted for fit using a draw string seated in a channel sewn about the periphery of the sheet. The inventor is also aware of a covering U.S. Pat. No. 5,922,437 applicable to covering household items and leverages a drawstring or elastic ribbon enclosed within a sewn channel for the purpose of securing the covering over the item. A drawback with the coverings described above is that they are rather limited to certain small number of mattress sizes (U.S. Pat. No. 5,046,207) or to specific household items (U.S. Pat. No. 5,922,437).

Therefore, what is clearly needed is a fitted bed sheet that can be adjusted in place to fit any size, shape, or thickness of a mattress in a quick and efficient manner.

BRIEF SUMMARY OF THE INVENTION

According to an embodiment of the present invention, a material cover is provided including a swath of material of sufficient width and length to cover a form, a cable sheath generally disposed about the peripheral edge of the swath of material on one side of the material swath, an elastic cable having a diameter just smaller than the inside diameter of the cable sheath threaded through the cable sheath, a cinch mechanism disposed in the path of the cable sheath, the cinch mechanism having an inside diameter the same or just smaller than twice the diameter of the elastic cable, and a pull line attached to or formed contiguously from the elastic cable, the pull line extending some length to an ergonomic handle operable by a user.

In one embodiment, the swath of material is a bed sheet and the form covered is a mattress. In this embodiment, the bed sheet may be one of cotton, organic cotton, Modal™, bamboo, eucalyptus, satin, silk, hemp, rayon, lyocell, and polypropylene or a blend of two or more of those. In one embodiment, the material cover further includes a lock mechanism threaded onto the pull line, the lock mechanism urged toward the cinch mechanism to lock and away from cinch mechanism to unlock and loosen tension in the elastic cable.

In one embodiment, the cover is a bed sheet covering a mattress wherein the mattress is one of a crib size, double mattress size, king size mattress, or queen mattress size. In one embodiment, the cable sleeve has sleeve gaps equidistantly located about the cable sleeve to discourage or prevent bunching of the fitted sheet cinched or otherwise secured in place over a mattress of the desired mattress size. In one embodiment, the elastic cable is a bungee cord having a diameter of one-quarter inch. In one embodiment, the pull line is a rope or draw string attached to the elastic cable. In one embodiment, the pull line is a materially contiguous extension of the elastic cable doubling the diameter of the cable.

In one embodiment, the cinch mechanism is formed of polymer and is spring loaded to compress on the pull line. In another embodiment, the cinch mechanism is fabricated of fabric material and has an inside diameter the same or just smaller than the diameter of the cable multiplied by two. In one embodiment using a lock mechanism, the lock mechanism 1s fabricated of a metal or a polymer. In one embodiment, the material cover includes a pull handle attached to the end of the pull line, the pull handle used to pull the elastic cable tight.

According to another embodiment, a method is provided for covering a form in a fitted manner using a swath of material of sufficient width and length to cover the form the material swath including a cable sheath dispose peripherally about the edges thereof sheathing an elastic cable attached to or contiguous with a pull line threaded through a cinch mechanism. The method includes steps for (a) placing the material swath over the form in a tension relaxed and expanded state, (b) advancing the elastic cable and material swath past the sides of the form, (c) pulling the pull line through the cinch band to constrict the elastic cable, and (d) tying, clamping or otherwise locking the created constriction in the elastic cable in place where the material swath tightly conforms to and covers the form.

In one aspect of the method, the swath of material is a bed sheet and the form covered is a mattress. In one aspect in (d), a lock mechanism threaded onto the pull line is urged toward the cinch mechanism to lock and away from cinch mechanism to unlock and loosen tension in the elastic cable. In one aspect of the method, the cinch mechanism is formed of polymer and is spring loaded to compress on the pull line. In another aspect, the cinch mechanism is fabricated of fabric material and has an inside diameter the same or just smaller than the diameter of the cable multiplied by two. In one aspect of the method, in (c) a pull handle is provided and attached to the end of the pull line, the pull handle used to pull the elastic cable tight.

DETAILED DESCRIPTION OF THE INVENTION

In various embodiments described in enabling detail herein, the inventor provides a unique system for adjusting a bed sheet to fit mattresses of diverse sizes. The present invention is described using the following examples, which may describe more than one relevant embodiment falling within the scope of the invention.

Figure 1:
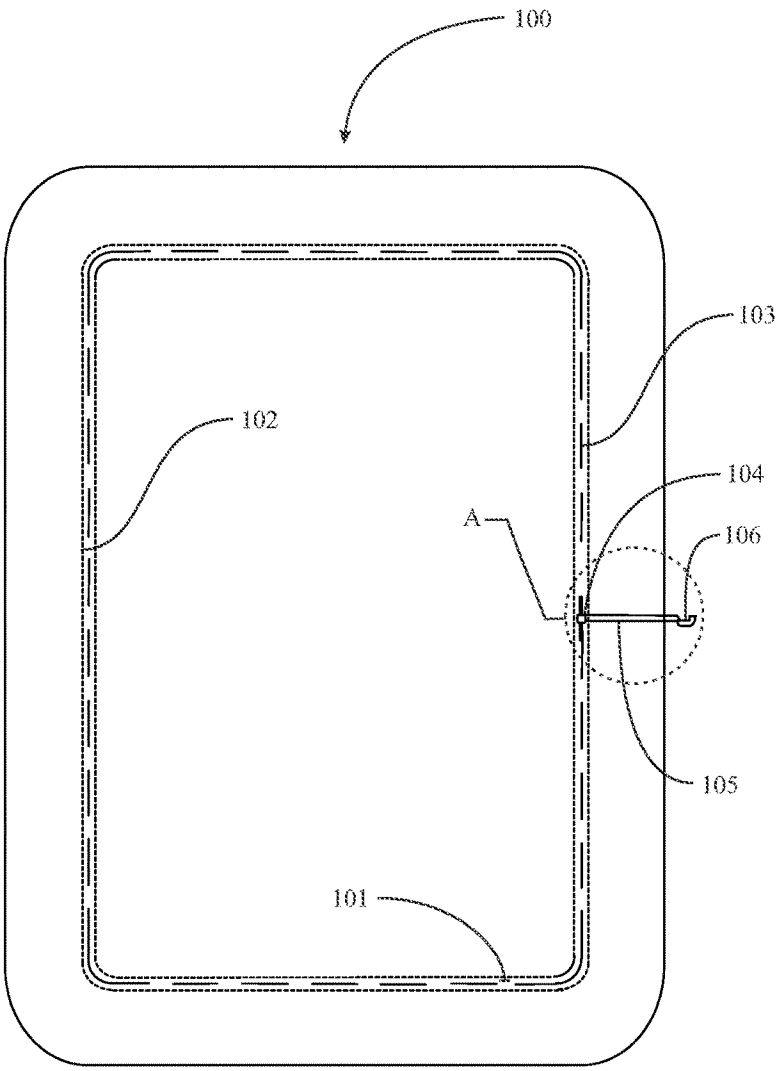
FIG. 1 is an overhead view of an adjustable bed sheet fitted on a mattress according to an embodiment of the present invention.

FIG. 1 is an overhead view of an adjustable bed sheet 100 fitted on a mattress according to an embodiment of the present invention. Bed sheet 100 may be manufactured of a variety of different fabrics such as cotton, organic cotton, bamboo, eucalyptus, satin, silk, or hemp. Fitted sheet 100 may be made of any conventional or waterproof fabric known in the art. Bed sheet 100 may include a fabric sleeve 102 (broken boundary lines on the underside of sheet 100. Sleeve 102 is adapted to accept an elastic cable, band, or cord there through. Sleeve 102 may be created by sewing a hem about the outside edge of fitted bed sheet 100.

In one embodiment, sleeve 102 includes sleeve gaps 101 depicted herein as open spaces in sleeve 102. Such gaps may be equidistantly located to discourage or prevent bunching of the fitted sheet 100 when it is cinched or otherwise secured in place over a mattress of the desired mattress size. Sleeve gaps 101 may be of any length less than each side of the fitted sheet 100 and may function to provide less friction when tightening or loosening an elastic cable referenced herein as an elastic cable 103. Elastic cable 103 may be a bungee cord, an elastic round cord, or a heavy-duty elastic cable of one-eighth of an inch in diameter or thicker. In one embodiment, there are four elastic cable sections connected by screw locks or turn buckles to assemble cable 103. In this embodiment, each elastic cable section is approximately seventy inches in length. A cable section at a tension-relaxed length of seventy inches may be stretched to a length of approximately 102 inches.

In this embodiment, elastic cable 103 is attached or otherwise connected at each end thereof to a cinch band 104 within the broken boundary labeled A. Cinch band 104 may be manufactured from a lightweight polymer or may be fabricated from fabric and sewn into form. Cinch band 104 may provide a bottle neck of a diameter that produces suitable tension in the elastic cable 103 when being advanced there through to secure a fitted sheet like fitted sheet 100 tightly around a mattress of crib size, double mattress size, king or queen mattress size. In a preferred embodiment, fitted bed sheet 100 is not limited to use with generally rectangular mattresses but may be fitted over a wide variety of other sizes, shapes, or thicknesses of mattresses. In a preferred embodiment cable 103 may be one quarter of an inch in diameter or greater.

Fitted bed sheet 100 includes a second short cable 105 attached to the elastic cable 103 through cinch band 104 within A. Second cable 105 may be fabricated from any small diameter cord, drawstring, or rope material that has sufficient tensile strength to enable an operator to pull elastic cable 103 through cinch band 104. A cable handle 106 is provided and is attached or otherwise fixed to the free end of second cable 105 within area A to enable an operator to physically pull cable 103 in ergonomic fashion to constrict elastic cable 103 tightly around the periphery of the mattress.

An operator pulls cable 103 through cinch band 104 to cinch the diameter of the bed sheet securely about a mattress. Sleeve 102 has a diameter of just greater than the diameter of the elastic cable 103 with enough of a diameter difference to allow for low friction drag and even tension pull when elastic cable 103 is pulled into the secure position. Removing a fitted sheet like sheet 100 may be accomplished by an operator using cable handle 106 pulled from underneath the mattress to a position where elastic cable 103 may be stretched out around the mattress and the fitted sheet may be removed from the fitted position.

When fitted sheet 100 is attached in the fitted position, there should be enough length in pull cord 105 so that cable handle 106 is readily available to the user for quick release of elastic cable 103 and removal of sheet 100. In a preferred embodiment, sleeve 102 has a diameter just greater than the diameter of elastic cable 103 with enough of a diameter difference to allow for low friction drag and even tension pull when elastic cable 103 is pulled to fit the bed sheet into a secure position.

Figure 2:
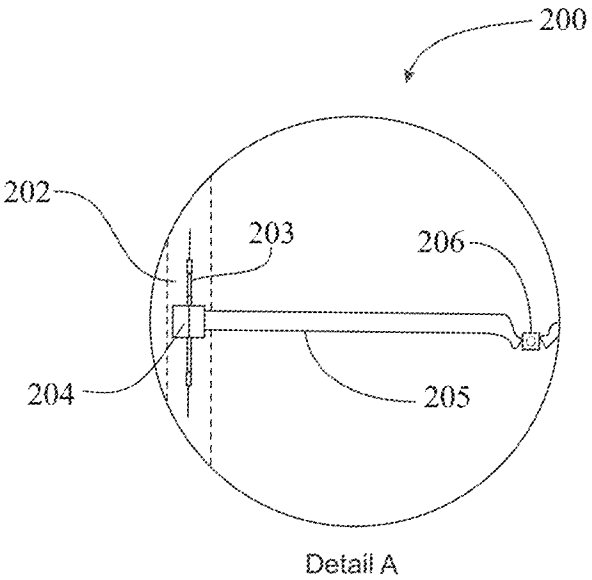
FIG. 2 is an exploded view of detail A of FIG. 1.

FIG. 2 is an exploded view of detail A of FIG. 1. Detail A is given an element number 200 in this example indicative of an area of adjustment control of the constricted or relaxed state of a bed sheet like sheet 100. In this embodiment, elastic cable 203 is analogous to elastic cable 103 of FIG. 1. Elastic cable 203 may be threaded through cable sleeve 202 of fitted sheet 100. Cable sleeve 202 is analogous in this embodiment to sleeve 102 of FIG. 1. In one embodiment, each end of elastic cable 203 of FIG. 1 may be connected and directed to pass through a cinch band or "cable catch" 204 referred to in this example as a catch device. Cinch band 204 may be analogous to cinch band 104 of FIG. 1, however other cable catch type architectures may be used herein without departing from the spirit and scope of the present invention.

In this instance, second cable 205 is not a separate cord, rope, or tether attached to cable 103 of FIG. 1. Second cable 205 is formed as a double diameter elastic cable and is contiguous in material with cable 203 and is therefore elastic having double the diameter and tensile strength of a single elastic cable. Double elastic cable 205 then may be threaded through a cinch lock device 206. Cinch lock 206 may be a metallic or polymer article of manufacture that is fitted over the double elastic cable and may be advanced linearly along the double cable in both directions. In operation cinch lock 205 may be urged in a direction of cinch band 204 along double cable 205 used to retain elastic cable 103 via friction or spring tension in a tightened state of constriction or otherwise in a locked position about a mattress. Double elastic cable 205 is provided at a sufficient length as to enable tucking the handle beneath a mattress whereby an operator may pull out the handle and provide operable access to locking device 206 for fitting and unfitting and releasing a bed sheet from a mattress such as fitted bed sheet 100 of FIG. 1.

Figure 3:
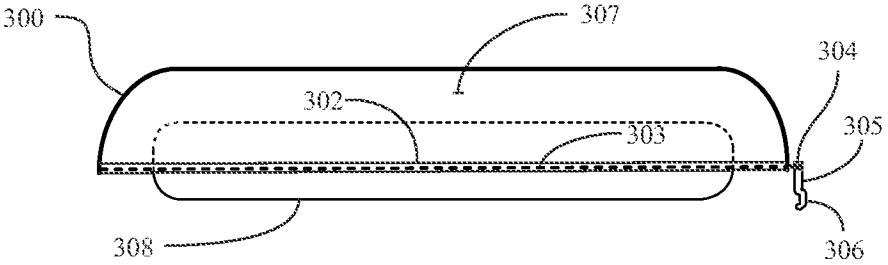
FIG. 3 is a diagrammatic view of adjustable bed sheet over a mattress.

FIG. 3 is a diagrammatic view of adjustable bed sheet 300 over a mattress 308. This view may take the perspective of looking toward a headboard 307. sheet 300 is analogous to sheet 100 of FIG. 1. It is noted that FIG. 1 depicts elastic cable 103 constricted at the underside of the sheet-fitted mattress. In this embodiment, cable sleeve 302 is analogous to cable sleeve 102 of FIG. 1 and is cinched by the cinch band 304 analogous at least in part to cinch band 104 of FIG. 1. The goal is to achieve a perfect wrinkle free fit over mattress 308 using the tension placed in elastic cable 303, which is analogous to cable 103 of FIG. 1.

In one embodiment, cinch band 304 may be spring loaded to catch and retain the amount of tension provided by an operator to elastic cord 303 in channel 302. Once the operator cinches bed sheet 300 over mattress 308, a lock may be used to retain the constriction force on the cable keeping the sheet tightly fitted about the mattress. Sheet 300 may be manufactured from a variety of textiles, both organic and synthetic. Textile blends are also common including cotton and polyester. Cotton provides absorbency and a soft hand, while polyester adds durability and wrinkle resistance. Other common fibers used in the manufacturing of bed sheets include linen, silk, Modal™, bamboo, rayon, lyocell, and polypropylene. In one embodiment, the textile may be incorporated with elastic fiber enabling the material, itself, to be flexible, and form fitting a variety of shapes and sizes. One with skill in the art will understand that the embodiments taught in enabling detail herein are, in fact, exemplary, and there may well be other variations, not discussed in detail, which will fall within the scope of the invention.

It will be apparent to one with skill in the art that the adjustable bed sheet of the present invention may be provided using some or all the elements described herein. The arrangement of elements and functionality thereof relative to the bed sheet of the invention is described in different embodiments each of which is an implementation of the present invention. While the uses and methods are described in enabling detail herein, it is to be noted that many alterations could be made in the details of the construction and the arrangement of the elements without departing from the spirit and scope of this invention. The present invention is limited only by the breadth of the claims below.

The invention claimed is:

1. A material cover comprising: a swath of material having a peripheral edge around a rectangular shape with a width and length to cover a form, said form having a top surface and a bottom surface; a cable sheath disposed about the entire peripheral edge of the swath of material; an elastic cable having a diameter smaller than an inside diameter of the cable sheath and threaded through the cable sheath; a spring loaded cinch mechanism is integrated and disposed along an identical path of the cable sheath, the spring loaded cinch mechanism having an inside diameter being the same or smaller than twice the diameter of the elastic cable thereby feeding two portions of the elastic cable within and through the spring loaded cinch mechanism wherein the spring loaded cinch mechanism clamps and holds the two portions in place under tension; and a pull line formed contiguously from the elastic cable, the pull line extending a length to an ergonomic handle operable by a user; where in the pull line extends from the peripheral edge on the bottom surface to an area outside of the form.

2. The material cover of claim 1, wherein the swath of material is a bed sheet and the form covered is a mattress.

3. The material cover of claim 2, wherein the bed sheet is one of a cotton, organic cotton, bamboo, eucalyptus, satin, silk, hemp, rayon, lyocell, and polypropylene or a blend of two or more of those.

4. The material cover of claim 2, wherein the mattress is one of a crib size, double mattress size, king mattress size, or queen mattress size.

5. The material cover of claim 1, further including a lock mechanism threaded onto the pull line, the lock mechanism urged toward the spring loaded cinch mechanism to lock and urged away from the spring loaded cinch mechanism to unlock and loosen tension in the elastic cable.

6. The material cover of claim 5, wherein the lock mechanism is fabricated of a metal or a polymer.

7. The material cover of claim 4, wherein the cable sheath has sleeve gaps equidistantly located about the cable sheath to discourage or prevent bunching of the bed sheet from being cinched or otherwise secured in place over the mattress.

8. The material cover of claim 1, wherein the elastic cable is a bungee cord having a diameter of one-quarter inch.

9. The material cover of claim 1, wherein the pull line is a rope or draw string attached to the elastic cable.

10. The material cover of claim 1, wherein the pull line is a materially contiguous extension of the elastic cable doubling the diameter of the elastic cable.

11. The material cover of claim 1, wherein the spring loaded cinch mechanism is formed of a polymer and is configured to compress on the pull line.

12. The material cover of claim 1, wherein the spring loaded cinch mechanism is fabricated of fabric material.

13. The material cover of claim 1, wherein the ergonomic handle is attached to an end of the pull line, the ergonomic handle used to pull the elastic cable tight.

14. A method for covering a form in a fitted manner using a swath of material of a width and length to cover the form, the form having a top surface and a bottom surface, the material swath including a cable sheath disposed peripherally and continuously about all edges of the swath of material sheathing an elastic cable attached to or contiguous with a pull line threaded through a spring loaded cinch mechanism, wherein the spring loaded cinch mechanism is integrated and disposed along a same path as the cable sheath the method including:

(a) placing the material swath over the form in a tension relaxed and expanded state;

(b) advancing the elastic cable and material swath past sides of the form;

(c) pulling the pull line through the spring loaded cinch mechanism to constrict the elastic cable by feeding two portions of the elastic cable within and through the spring loaded cinch mechanism wherein the spring loaded cinch mechanism clamps and holds the two portions in place under tension; and (d) clamping or otherwise locking the created constriction in the elastic cable location where the material swath tightly conforms to and covers the form and the pull line extends from a peripheral edge at the bottom surface to outside the form.

15. The method of claim 14, wherein the swath of material is a bed sheet and the form covered is a mattress.

16. The method of claim 14, wherein in (d), a lock mechanism threaded onto the pull line and urged toward the spring loaded cinch mechanism to lock and urged away from the spring loaded cinch mechanism to unlock and loosen tension in the elastic cable.

17. The method of claim 14, wherein in the spring loaded cinch mechanism is formed of a polymer and is configured to compress on the pull line.

18. The method of claim 14, wherein the spring loaded cinch mechanism is fabricated of fabric material and has an inside diameter the same or smaller than the diameter of the elastic cable multiplied by two.

19. The method of claim 14, wherein in (c) a pull handle is provided and attached to an end of the pull line, the pull handle used to pull the elastic cable tight.

* * * * *